US010537136B2

(12) United States Patent
Li et al.

(10) Patent No.: US 10,537,136 B2
(45) Date of Patent: Jan. 21, 2020

(54) HEATING DEVICE FOR CIGARETTE

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 169 days.

(21) Appl. No.: 15/246,457

(22) Filed: Aug. 24, 2016

(65) Prior Publication Data

US 2016/0360794 A1 Dec. 15, 2016

(30) Foreign Application Priority Data

Sep. 29, 2015 (CN) ..... 2015 2 0760603 U

(51) Int. Cl.
*A24F 47/00* (2006.01)
*H05B 3/46* (2006.01)

(52) U.S. Cl.
CPC ..... *A24F 47/008* (2013.01); *H05B 3/46* (2013.01)

(58) Field of Classification Search
CPC ..... A24F 47/008; A24F 47/00; H05B 3/24; H05B 3/46
See application file for complete search history.

(56) References Cited

U.S. PATENT DOCUMENTS

2013/0014772 A1* 1/2013 Liu ..... A24F 47/008 131/329
2014/0190477 A1* 7/2014 Qiu ..... A61M 15/06 128/202.21

* cited by examiner

*Primary Examiner* — Ibrahime A Abraham
*Assistant Examiner* — Biniam B Asmelash
(74) *Attorney, Agent, or Firm* — Cheng-Ju Chiang

(57) ABSTRACT

An exemplary heating device for a cigarette includes a housing, a heating chamber, and a power supply. The heating chamber is arranged at a first end of the housing, and is configured for receiving at least one part of the cigarette. The heating chamber defines an air inlet and an opening. The opening is configured for receiving an end of the cigarette. The heating chamber includes a plurality of heating pieces arranged on two opposite inner walls. Each heating piece includes a heating surface facing an interior space of the heating chamber. The power supply is arranged at an opposite second end of the housing, and is configured for feeding the heating pieces power.

10 Claims, 5 Drawing Sheets

HEATING DEVICE FOR CIGARETTE

TECHNICAL FIELD

The present invention relates to a smoking set, and particularly to a heating device for heating a cigarette.

BACKGROUND ART

When a cigarette burns, dozens of carcinogenic ingredients are released. As a substitute, electronic cigarettes are becoming more and more popular. A typical electronic cigarette is configured for heating tobacco liquid to form aerosol. However, for most users, taste of the electronic cigarette is not as good as cigarettes.

What is needed, therefore, is a heating device, which can overcome the above shortcomings.

SUMMARY

An exemplary heating device for a cigarette includes a housing, a heating chamber, and a power supply. The heating chamber is arranged at a first end of the housing, and is configured for receiving at least one part of the cigarette. The heating chamber defines an air inlet and an opening. The opening is configured for receiving an end of the cigarette. The heating chamber includes a plurality of heating pieces arranged on two opposite inner walls. Each heating piece includes a heating surface facing an interior space of the heating chamber. The power supply is arranged at an opposite second end of the housing, and is configured for feeding the heating pieces power.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
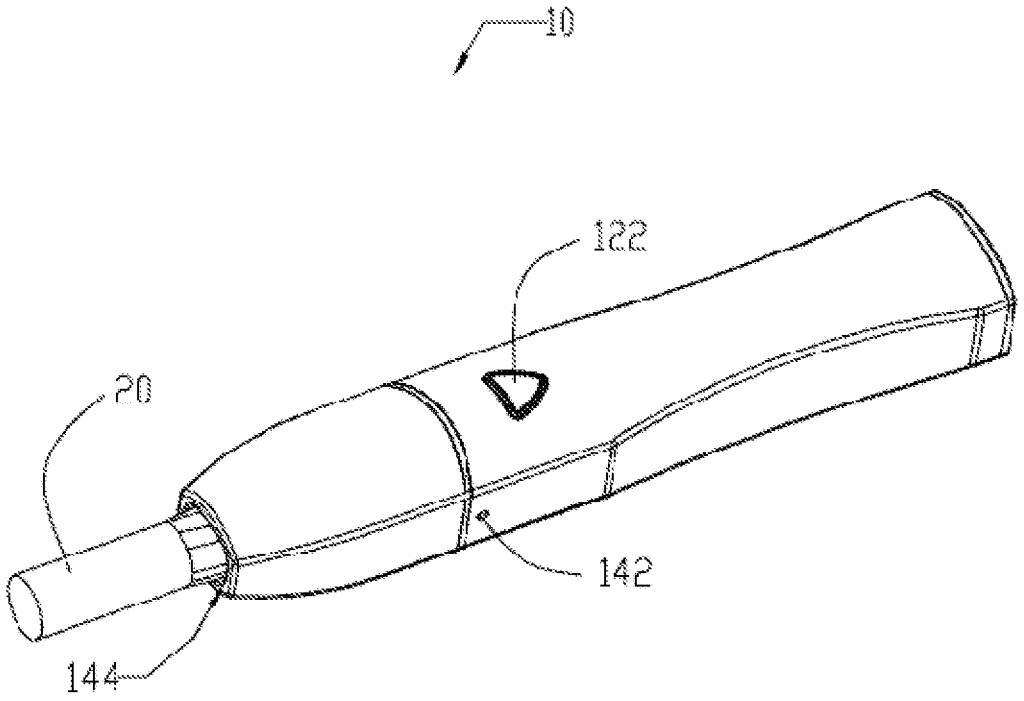
FIG. 1 is a perspective view of a heating device coupling with a cigarette according to a first embodiment, including a heating chamber.
Figure 2:
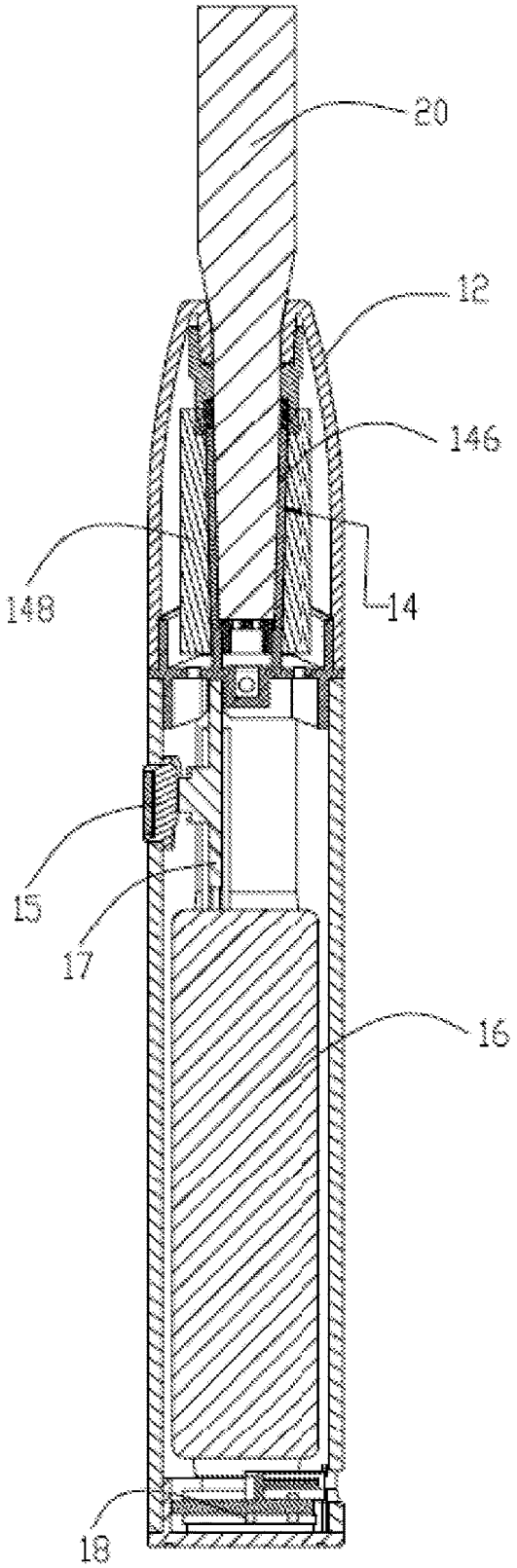
FIG. 2 is a cross-sectional view of the heating device of FIG. 1.
Figure 3:
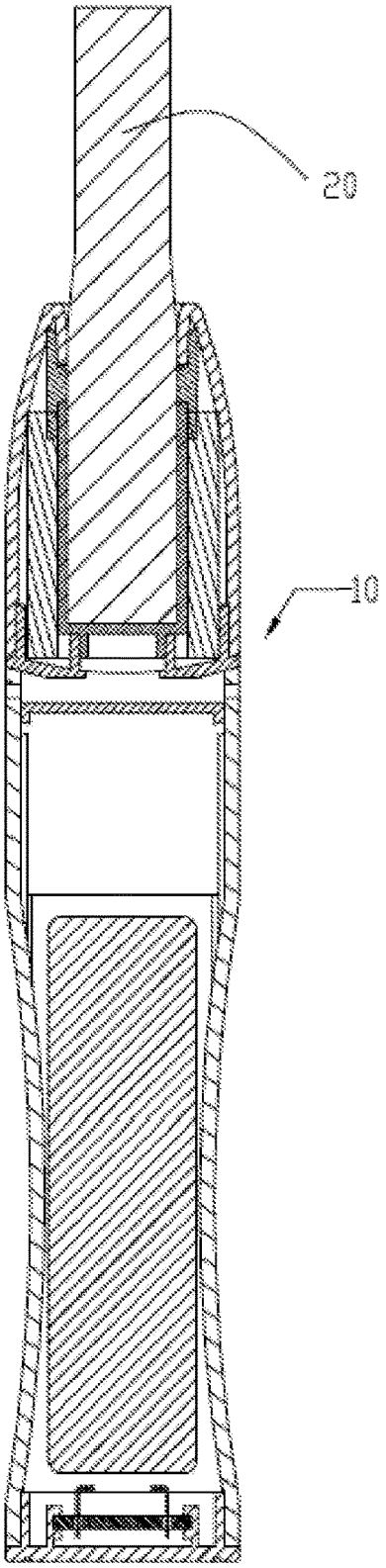
FIG. 3 is another cross-sectional view of the heating device of FIG. 1.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIGS. 1-6, a heating device 10 is configured for heating a cigarette 20 to form aerosol. The cigarette 20 is substantially cylindrical, and includes a mouthpiece 22 and a main body 24. The mouthpiece 22 is configured (i.e., structured and arranged) for filtering the aerosol, and the main body 24 includes substance for generating aerosol, for example, tobacco shred. The cigarette 20 may be a typical cigarette, or a special cigarette made by cigarette production equipments.

Figure 4:
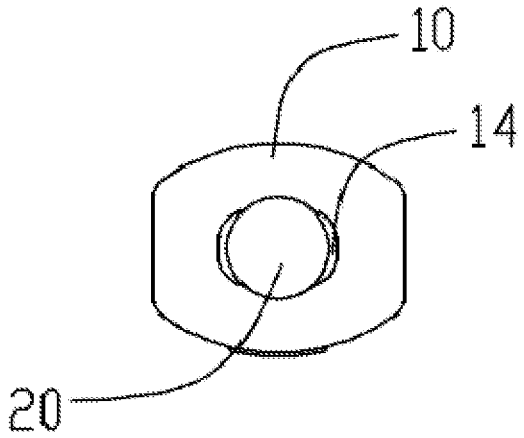
FIG. 4 is a top plan view of the heating device of FIG. 1, coupling with the cigarette.
Figure 5:
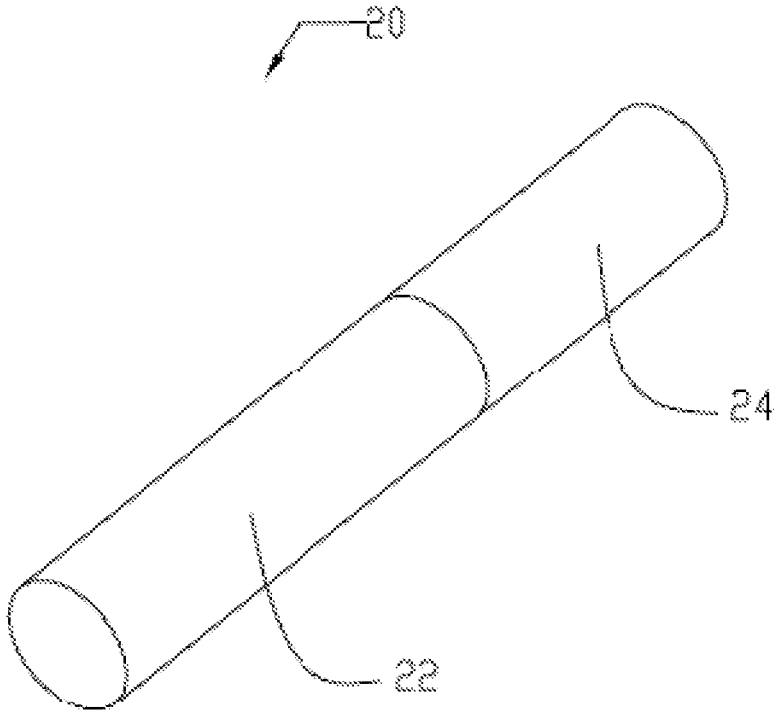
FIG. 5 is a perspective view of a cigarette before use.

The heating device 10 includes a housing 12, a heating chamber 14 arranged at a first end of the housing 12, and a power supply 16 at an opposite second end of the housing 12. The heating chamber 14 defines an air inlet 142 and an opening 144. The opening 144 is configured for receiving an end of the cigarette 20. In the present embodiment, the heating chamber 14 is substantially an ellipse in cross-section (as seen in FIG. 4). In detail, in cross-section, the heating chamber 14 includes two elliptical arcs and two parallel straight lines.

The heating chamber 14 includes two heating pieces 146 arranged on two opposite inner walls, and configured for heating the cigarette 20. A maximum distance between the two heating pieces 146 is less than an external diameter of the cigarette 20. Each heating piece 146 includes a heating surface facing an interior space of the heating chamber 14. In the present embodiment, the heating surface is a smooth curved surface. It is to be understood that, the heating surface may include a plurality of toothed protrusions. The power supply 16 is configured for feeding the heating pieces 146 power. The power supply 16 may be a battery.

The heating device 10 further includes a printed circuit board (PCB) 17 arranged between the heating chamber 14 and the power supply 16. The PCB 17 is configured for controlling heating of the two heating pieces 146. Based on a program of the PCB 17, the two heating pieces 146 may work simultaneously or in turn. In use, a temperature of the heating chamber 14 is kept in an approximate range from 160 Celsius degree to 350 Celsius degree by controlling the two heating pieces 146. Within the above range, the substance in the cigarette 20 is heated to form aerosol, and the cigarette will not burn. Quite usefully, a temperature sensor (not shown) is arranged in the heating chamber 14. When a temperature of the heating chamber 14 is higher than a predetermined temperature, the heating pieces 146 are turned off.

The heating device 10 further includes a switch 15 configured for turning on or off the heating pieces 146. When the switch 15 is pressed, the heating pieces 146 heat the cigarette 20.

The heating device 10 further includes a charging terminal 18 at an end of the housing 12. The power supply 16 is positioned between the heating chamber 14 and the charging terminal 18. The charging terminal 18 is electrically connected to the power supply 16, and is configured for charging the power supply 16 when connected to an external power supply.

The heating device 10 further includes a heat insulation layer 148 arranged between the housing 12 and the heating pieces 146. The heating layer 148 may be made of asbestos. The heat insulation layer 148 keeps a temperature of an outer surface of the housing 12 below 40 Celsius degrees.

Figure 6:
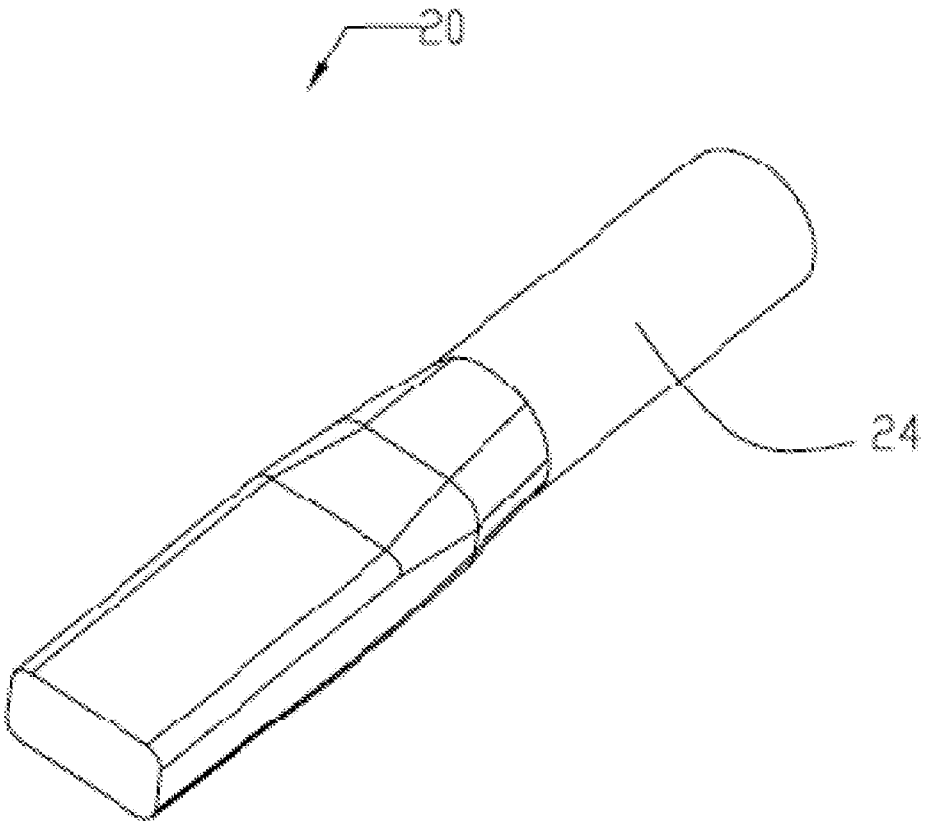
FIG. 6 is a perspective view of a cigarette, which is pressed flat by the heating chamber.

In use, the cigarette 20 is inserted into the heating chamber 14 via the opening 144 until an end of the cigarette 20 reaches a bottom of the heating chamber 14. Since the heating chamber 14 is substantially an ellipse in cross-section, during insertion the cigarette 20 is pressed flat by the heating chamber 14 to conform a shape of the heating chamber 14 (as seen in FIG. 6). In this way, the cigarette 20 is in tight contact with the heating pieces 146. Then the switch 15 is pressed, the heating pieces 146 starts heating the main body 24 of the cigarette 20, thus generating aerosol. The user of the heating device 10 can smoke via the mouthpiece 22. When the cigarette 20 is used up, the cigarette 20 is pulled out and is replaced by a new one. During heating process, the cigarette 20 is substantially kept in its integrity, and therefore, it is very convenient to pull out the used cigarette.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A heating device for a cigarette having a circular cross section, comprising:

a housing;

a heating chamber arranged at a first end of the housing, chamber being configured for receiving at least one part of a cigarette, a shape of an inner contour of the heating chamber being different from a shape of the at least one part of the cigarette, wherein the at least one part of the cigarette is pressed to conform the shape of the heating chamber during insertion of the at least one part of the cigarette into the heating chamber, the heating chamber defining an air inlet and an opening, the opening being configured for allowing the insertion of the at least one part of the cigarette, and having an opening width along a preset direction being smaller than a diameter of the circular cross section of the cigarette, two heating pieces being arranged on two opposite inner walls of the heating chamber, each heating piece comprising a heating surface an interior space of the heating chamber; and a power supply at an opposite second end of the housing, the power supply being configured for feeding power to the two heating pieces, and wherein the inner contour of the heating chamber is shaped as an ellipse in cross-section.

2. The heating device according to claim 1, further comprising a heat insulation layer arranged between the housing and the two heating pieces.

3. The heating device according to claim 1, wherein the two heating pieces are configured to heat simultaneously.

4. The heating device according to claim 1, wherein a temperature of the heating chamber is kept in an approximate range from 160 Celsius degrees to 350 Celsius degrees.

5. The heating device according to claim 1, further comprising a switch configured for turning on or off the heating pieces.

6. The heating device according to claim 1, further comprising a charging terminal arranged at the second end of the housing, wherein the power supply is arranged between the heating chamber and the charging terminal.

7. The heating device according to claim 1, wherein the heating surface is a smooth curved surface.

8. The heating device according to claim 7, wherein a maximum distance between the two heating pieces is less than an external diameter of the at least one part of the cigarette.

9. The heating device according to claim 1, further comprising a printed circuit board arranged between the heating chamber and the power supply, wherein the printed circuit board is configured for controlling heating of the heating pieces.

10. The heating device according to claim 1, wherein a plurality of toothed protrusions are formed on the heating surface.

* * * * *